US010662016B2

(12) United States Patent
Shimamura et al.

(10) Patent No.: US 10,662,016 B2
(45) Date of Patent: May 26, 2020

(54) PAPER SHEET ACCOMMODATING APPARATUS AND PAPER SHEET ACCOMMODATING METHOD

(71) Applicant: FUJITSU FRONTECH LIMITED, Inagi (JP)

(72) Inventors: Tatsuya Shimamura, Inagi (JP); Hayato Minamishin, Inagi (JP); Yutaka Namikawa, Inagi (JP); Mitsutaka Nishida, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 16/363,267

(22) Filed: Mar. 25, 2019

(65) Prior Publication Data

US 2019/0218051 A1 Jul. 18, 2019

Related U.S. Application Data

(63) Continuation of application No. PCT/JP2016/078844, filed on Sep. 29, 2016.

(51) Int. Cl.
*G07D 11/13* (2019.01)
*B65H 29/00* (2006.01)
(Continued)

(52) U.S. Cl.
CPC ..... *B65H 29/006* (2013.01); *B65H 5/28* (2013.01); *B65H 29/008* (2013.01); *B65H 29/51* (2013.01);
(Continued)

(58) Field of Classification Search
CPC ..... B65H 2511/142; B65H 2515/60; B65H 2553/612; B65H 29/006; B65H 29/008;
(Continued)

(56) References Cited

U.S. PATENT DOCUMENTS 6,371,473 B1 * 4/2002 Saltsov ..... B65H 29/006 271/3.01
2003/0155704 A1 * 8/2003 Polidoro ..... B65H 29/006 271/216
(Continued)

FOREIGN PATENT DOCUMENTS

JP 8-67382 3/1996
JP 11-139617 5/1999
(Continued)

OTHER PUBLICATIONS

International Search Report dated Nov. 1, 2016 in corresponding International Application No. PCT/JP2016/078844.
(Continued)

*Primary Examiner* — Jeffrey A Shapiro
(74) *Attorney, Agent, or Firm* — Staas & Halsey LLP

(57) ABSTRACT

A paper sheet accommodating apparatus includes: a reel configured to supply a winded belt-like member; a drum configured to roll up a paper sheet together with the belt-like member supplied from the reel; and a transmission unit configured to transmit, at a time of roll-up of the belt-like member that is caused by rotation of the drum, rotation of the reel co-rotating with the roll-up, to the drum, to assist rotation of the drum.

4 Claims, 12 Drawing Sheets

(51) Int. Cl.
*B65H 29/51* (2006.01)
*B65H 5/28* (2006.01)
*G07D 9/00* (2006.01)
*G07D 11/165* (2019.01)

(52) U.S. Cl.
CPC ..... *G07D 9/00* (2013.01); *G07D 11/13* (2019.01); *G07D 11/165* (2019.01); *B65H 2301/41912* (2013.01); *B65H 2701/1912* (2013.01)

(58) Field of Classification Search
CPC .. B65H 29/51; B65H 5/28; B65H 2701/1912; B65H 2301/41912; G07D 11/13; G07D 11/165; G07D 11/17
USPC ..... 194/206, 207; 235/379; 209/534; 271/176, 216; 242/333.5, 334.5, 364.7, 242/364.8, 413.2, 419.2, 321.4, 528
See application file for complete search history.

(56) References Cited

U.S. PATENT DOCUMENTS

2006/0214350 A1* 9/2006 Saltsov ..... B65H 29/006 271/3.01
2010/0100245 A1* 4/2010 Oishi ..... B65H 29/006 700/275
2010/0163571 A1* 7/2010 Mizoro ..... B65H 29/006 221/71
2010/0181161 A1* 7/2010 Gauselmann ..... G07D 11/125 194/206
2011/0093116 A1* 4/2011 Nunn ..... B65H 29/006 700/219
2012/0103754 A1* 5/2012 Robinson ..... B65H 29/006 194/206
2012/0181298 A1* 7/2012 Miki ..... B65H 29/006 221/71
2012/0273516 A1* 11/2012 Cooke ..... B65H 29/006 221/71
2014/0090949 A1* 4/2014 Suetaka ..... B65H 5/28 194/206
2014/0116839 A1* 5/2014 Iwatsuki ..... B65H 29/006 194/206
2014/0191466 A1* 7/2014 Yokote ..... B65H 5/00 271/264
2018/0297801 A1* 10/2018 Minamishin ..... B65H 7/02

FOREIGN PATENT DOCUMENTS

JP 2009-107824 5/2009
JP 2013-199365 10/2013
JP 2015-14968 1/2015
WO 2013/145449 A1 10/2013

OTHER PUBLICATIONS

Written Opinion of the International Searching Authority dated Nov. 1, 2016 in corresponding International Application No. PCT/JP2016/078844.

* cited by examiner

PAPER SHEET ACCOMMODATING APPARATUS AND PAPER SHEET ACCOMMODATING METHOD

CROSS-REFERENCE TO RELATED APPLICATION

This application is a continuation application of International Application PCT/JP2016/078844, filed on Sep. 29, 2016 and designating the U.S., the entire contents of which are incorporated herein by reference.

FIELD

The present invention relates to a paper sheet accommodating apparatus and a paper sheet accommodating method.

BACKGROUND

For example, a paper money handling apparatus such as an Automated Teller Machine (ATM), a Cash Dispenser (CD), and a Teller Cash Recycler (TCR) includes a paper sheet accommodating apparatus that temporarily accommodates entered paper money. As a paper sheet accommodating apparatus of this type, there is known a configuration of accommodating paper money by rolling up paper money around a drum together with a tape supplied from a reel.

In a paper sheet accommodating apparatus having such a configuration, for example, at the time of roll-up of the tape, the tape is pulled out from the reel by the drum rotating, and the tape is caused to have tension, by fixing a shaft of the reel and a shaft having a connected torque limiter, using a one-way clutch or the like. In addition, in this paper sheet accommodating apparatus, for example, at the time of roll-back of the tape, the tape is unreeled from the drum by the drum reversing, and the tape is caused to have tension, by the reel rolling up the tape at higher speed than that of unreeling. In this paper sheet accommodating apparatus, a rotating speed difference between the drum and the reel is absorbed by the actuation of the torque limiter.

Patent Document 1: Japanese Patent Application Laid-open No. 2009-107824 A

Nevertheless, in the above-described related technique, in a case where the tape is elongated for increasing an accommodation amount of the paper sheet accommodating apparatus to large capacity, as the reel supplies the tape and the drum rolls up the tape, a diameter of the reel including the tape becomes smaller, and a roll-up diameter of the drum including the tape becomes larger. Nevertheless, because actuation torque of the torque limiter is constant, there is such a problem that, as the roll-up diameter becomes larger, pull-out load applied when the tape is pulled out from the reel becomes larger.

SUMMARY

According to an aspect of the embodiments, a paper sheet accommodating apparatus includes: a reel configured to supply a winded belt-like member; a drum configured to roll up a paper sheet together with the belt-like member supplied from the reel; and a transmission unit configured to transmit, at a time of roll-up of the belt-like member that is caused by rotation of the drum, rotation of the reel co-rotating with the roll-up, to the drum, to assist rotation of the drum.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, an embodiment of a paper sheet accommodating apparatus and a paper sheet accommodating method that are disclosed by the subject application will be described in detail based on the drawings. In addition, the paper sheet accommodating apparatus and the paper sheet accommodating method that are disclosed by the subject application are not limited by the following embodiment.

Embodiment

[Configuration of Paper Money Handling Apparatus]

Figure 1:
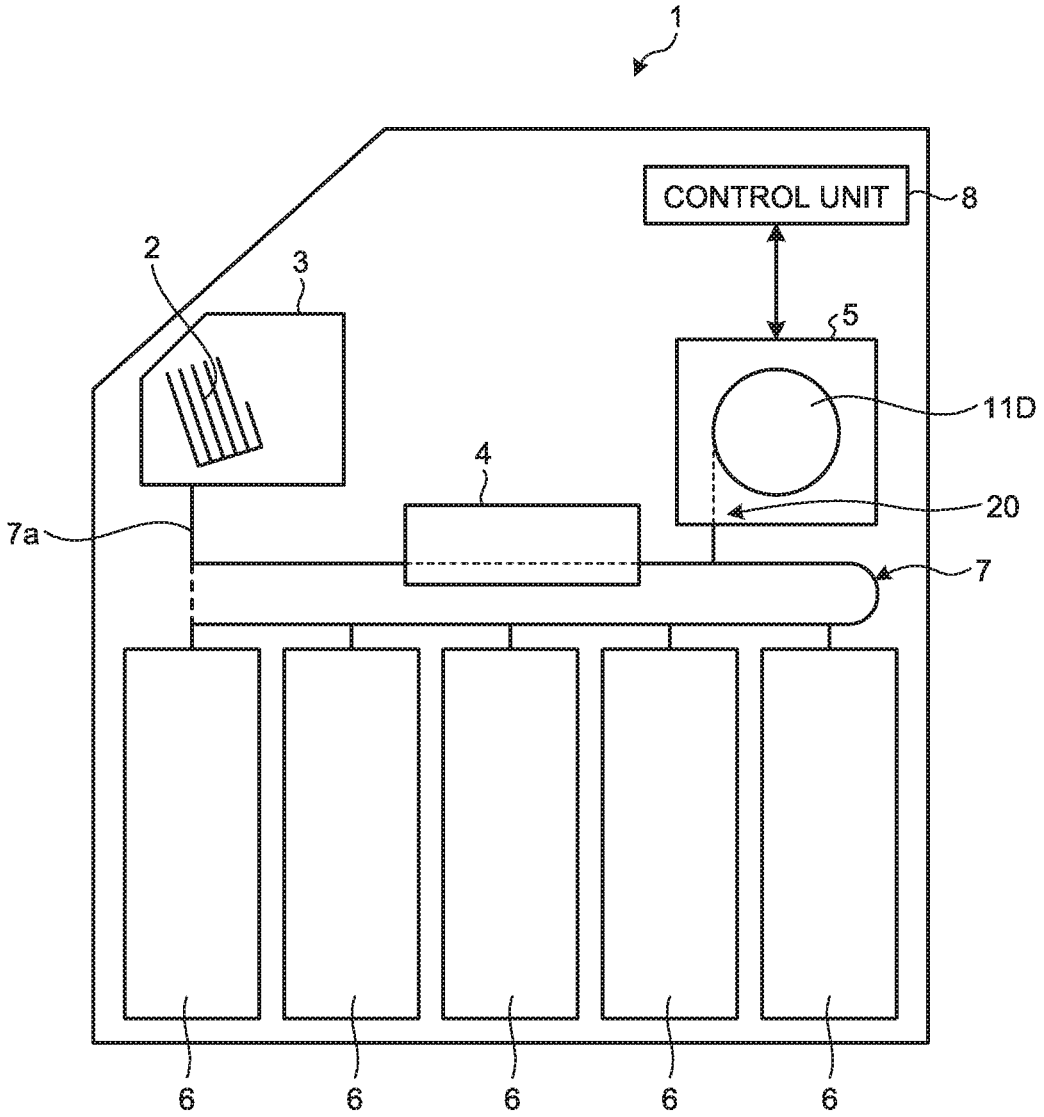
FIG. 1 is a schematic diagram illustrating an entire paper money handling apparatus including a paper sheet accommodating apparatus according to an embodiment.

FIG. 1 is a schematic diagram illustrating an entire paper money handling apparatus including a paper sheet accommodating apparatus according to an embodiment. As illustrated in FIG. 1, a paper money handling apparatus 1 according to an embodiment includes a deposit/disbursement unit 3 for depositing/disbursing paper money 2, and a distinguishing unit 4 for distinguishing true/false or the like of the paper money 2 deposited in the deposit/disbursement unit 3. In addition, the paper money handling apparatus 1 includes a temporary accommodating unit 5 that takes in, from a conveyance unit 20, the paper money 2 conveyed from the distinguishing unit 4, rolls up the paper money 2 around a drum 11D together with a tape being an example of a belt-like member, and temporarily accommodates the paper money 2, and a plurality of storage units 6 that stores the paper money 2 fed from the temporary accommodating unit 5.

In addition, the paper money handling apparatus 1 includes a conveyance mechanism 7 that conveys the paper money 2. The conveyance mechanism 7 includes a conveyance path 7*a* that conveys the paper money 2 between the deposit/disbursement unit 3, the distinguishing unit 4, the temporary accommodating unit 5, and the storage units 6. In addition, the paper money handling apparatus 1 includes a control unit 8 that controls the deposit/disbursement unit 3, the distinguishing unit 4, the temporary accommodating unit 5, the storage units 6, and the conveyance mechanism 7.

The temporary accommodating unit 5 incorporated into this paper money handling apparatus 1 corresponds to a paper sheet accommodating apparatus of an embodiment. Hereinafter, the description will be given while rephrasing the temporary accommodating unit 5 as a paper sheet accommodating apparatus 5. In the present embodiment, the paper money 2 is used as an example of a paper sheet, but a paper sheet is not limited to paper money. Examples of paper sheets include valuable securities such as bill, check, a gift ticket, various corporation securities, and stock certificate.

[Configuration of Paper Sheet Accommodating Apparatus]

Figure 2:
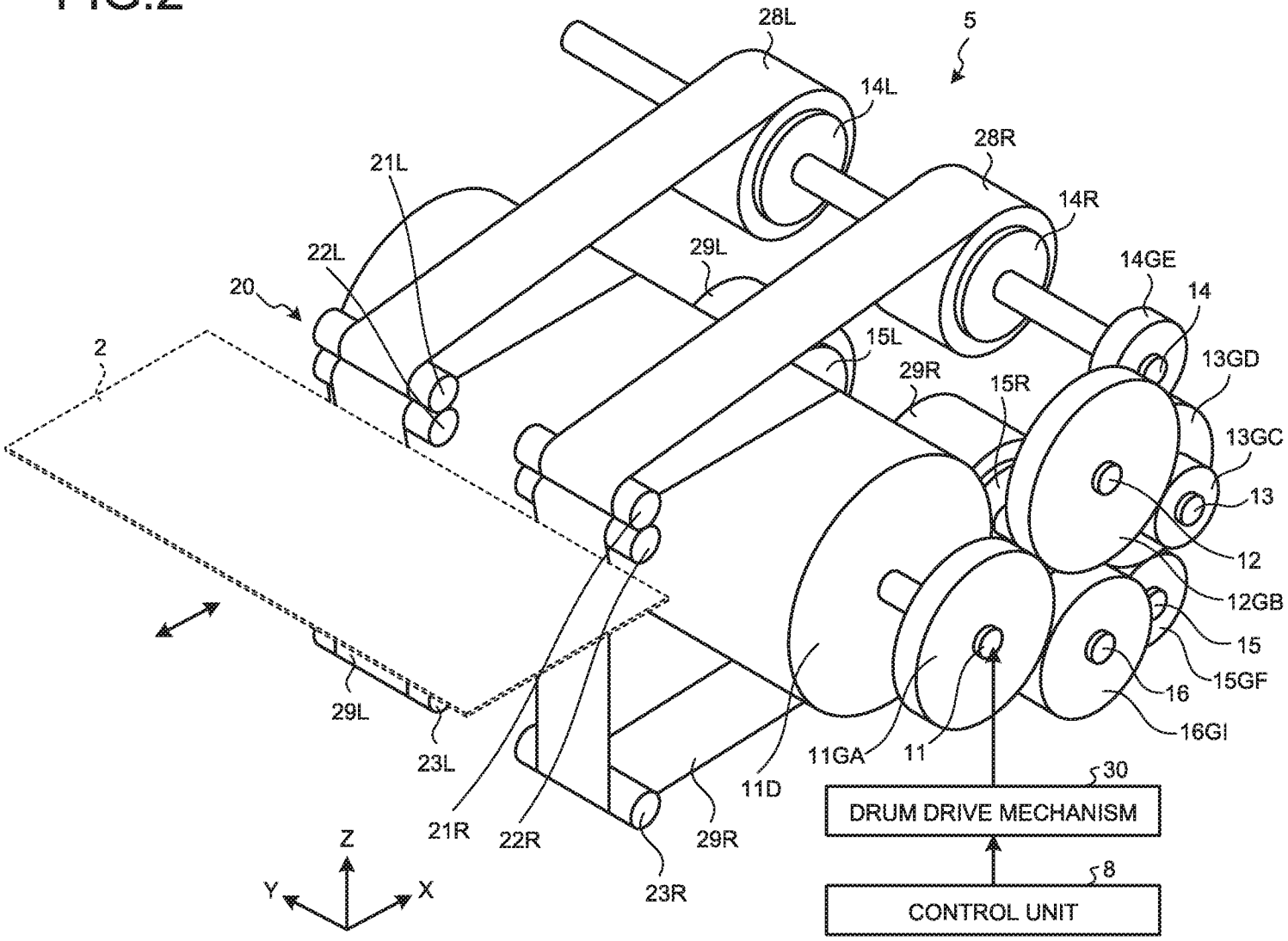
FIG. 2 is a perspective view illustrating the paper sheet accommodating apparatus according to an embodiment.
Figure 3:
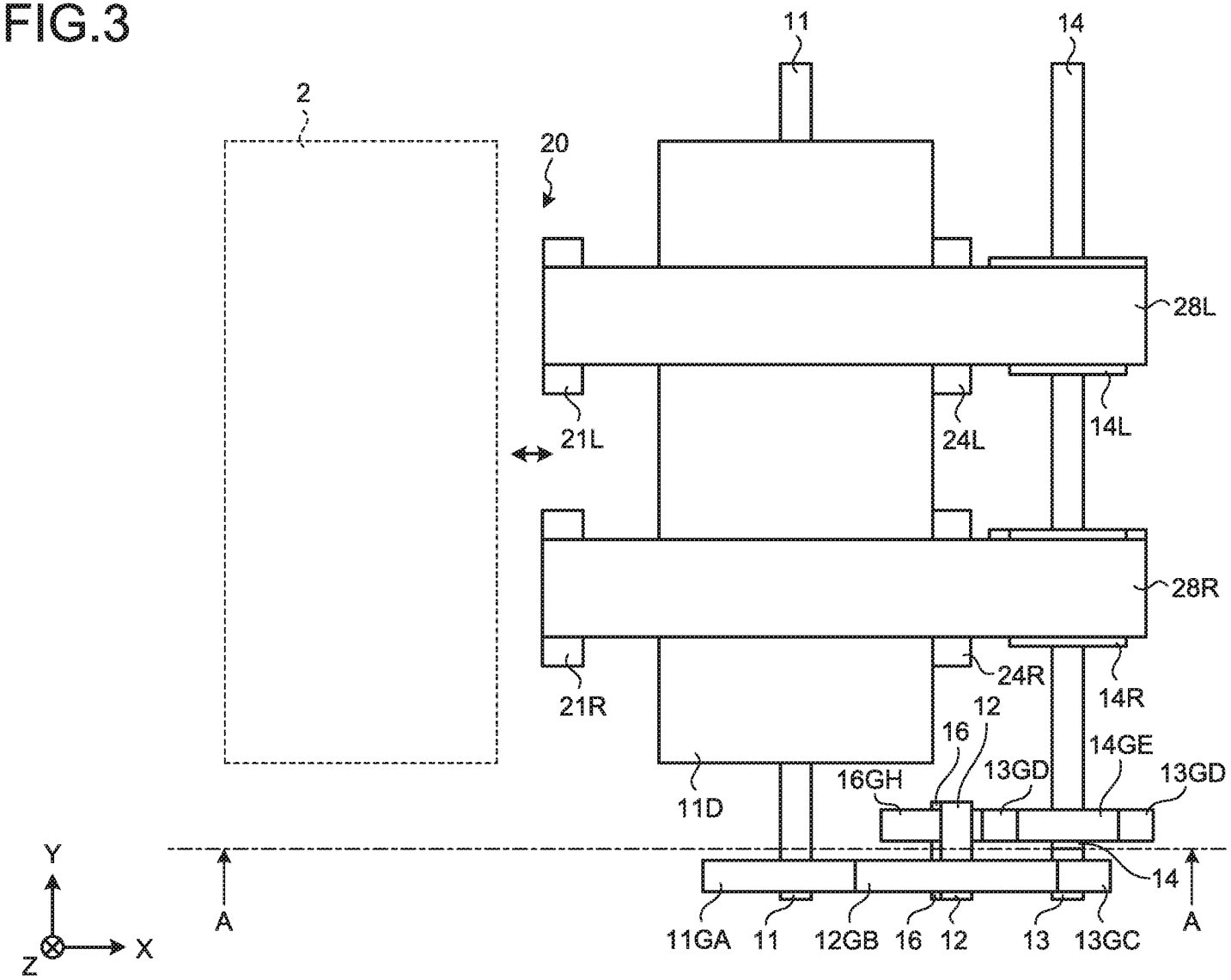
FIG. 3 is a plan view illustrating the paper sheet accommodating apparatus according to an embodiment.
Figure 4:
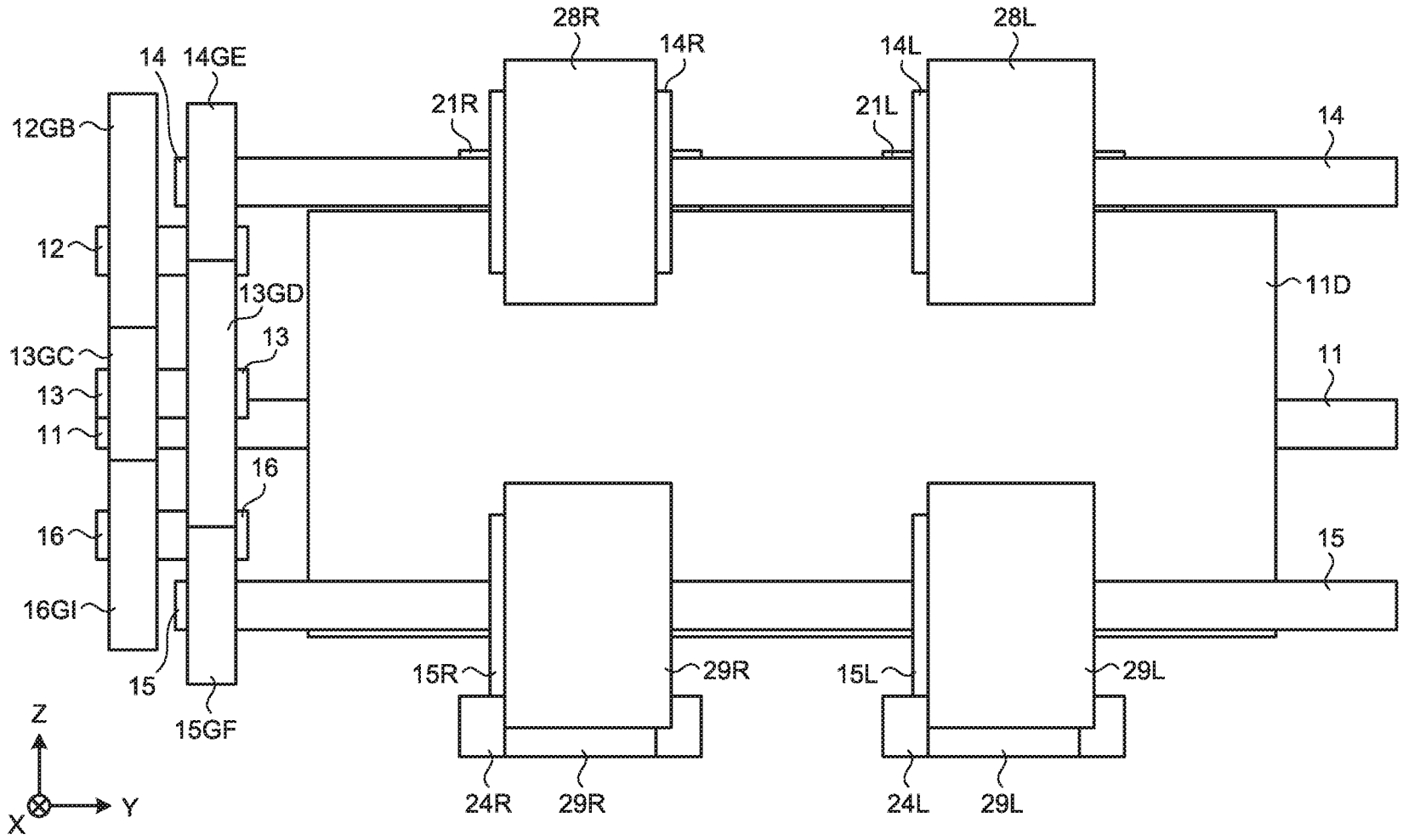
FIG. 4 is a rear view illustrating the paper sheet accommodating apparatus according to an embodiment.

FIG. 2 is a perspective view illustrating the paper sheet accommodating apparatus according to an embodiment. FIG. 3 is a plan view illustrating the paper sheet accommodating apparatus according to an embodiment. FIG. 4 is a rear view illustrating the paper sheet accommodating apparatus according to an embodiment.

The paper sheet accommodating apparatus 5 is provided adjacently to the conveyance path 7*a*, and includes the conveyance unit 20 that conveys the paper money 2 between the conveyance path 7*a* and the paper sheet accommodating apparatus 5. In addition, the paper sheet accommodating apparatus 5 includes a gear 11GA pivotally supported by a shaft 11, and the drum 11D. In addition, the paper sheet accommodating apparatus 5 includes a gear 12GB pivotally supported by a shaft 12. In addition, the paper sheet accommodating apparatus 5 includes gears 13GC and 13GD pivotally supported by a shaft 13. In addition, the paper sheet accommodating apparatus 5 includes a gear 14GE, and reels 14L and 14R that are pivotally supported by a shaft 14. In addition, the paper sheet accommodating apparatus 5 includes a gear 15GF, and reels 15L and 15R that are pivotally supported by a shaft 15. In addition, the paper sheet accommodating apparatus 5 includes gears 16GH and 16GI pivotally supported by a shaft 16.

Hereinafter, in FIG. 2, a deposit/disbursement direction of the paper money 2 with respect to the conveyance unit 20 is regarded as an X direction, a deposit direction is regarded as a forward direction, and a disbursement direction is regarded as a backward direction. In addition, in FIG. 2, a direction extending along the shaft 11 is regarded as a Y direction, a direction heading for the drum 11D from the gear 11GA is regarded as a forward direction, and a direction heading for the gear 11GA from the drum 11D is regarded as a backward direction. In addition, in FIG. 2, up-down of the paper sheet accommodating apparatus 5 is regarded as a Z direction, a direction heading for the shaft 14 from the shaft 15 is regarded as a forward direction, and a direction heading for the shaft 15 from the shaft 14 is regarded as a backward direction. In addition, hereinafter, a clockwise rotation direction and a counterclockwise rotation direction are respective rotation directions in a case where the paper sheet accommodating apparatus 5 is viewed from the Y forward direction. The X, Y, and Z directions are substantially orthogonal to each other.

The reels 14L and 14R respectively supply winded tapes 28L and 28R. The reels 14L and 14R are disposed on the upside of the drum 11D, supported by the common shaft 14, and disposed at a predetermined interval in the shaft 11 direction of the drum 11D. The reels 14L and 14R are supported by the shaft 14 via a torque limiter (not illustrated), and tensional force generated in the tapes 28L and 28R is regulated to predetermined tensional force or less.

Similarly, the reels 15L and 15R respectively supply winded tapes 29L and 29R. The reels 15L and 15R are disposed on the downside of the drum 11D, supported by the common shaft 15, and disposed at a predetermined interval in the shaft 11 direction of the drum 11D. The reels 15L and 15R are supported by the shaft 15 via a torque limiter (not illustrated), and tensional force generated in the tapes 29L and 29R is regulated to predetermined tensional force or less.

A travel route of the tape 28L is formed between the reel 14L and the drum 11D, and a pulley 21L is disposed on the travel route of the tape 28L. The pulley 21L is rotatably supported by a support shaft (not illustrated), and movably supports the tape 28L along the travel route. Similarly, a travel route of the tape 28R is formed between the reel 14R and the drum 11D, and a pulley 21R is disposed on the travel route of the tape 28R. The pulley 21R is rotatably supported by a support shaft (not illustrated), and movably supports the tape 28R along the travel route.

In addition, a travel route of the tape 29L is formed between the reel 15L and the drum 11D, and pulleys 22L, 23L, and 24L are disposed on the travel route of the tape 29L. The pulleys 22L, 23L, and 24L are rotatably supported by a support shaft (not illustrated) via a bearing member (not illustrated) such as a bearing, for example, and movably support the tape 29L along the travel route. Similarly, a travel route of the tape 29R is formed between the reel 15R and the drum 11D, and pulleys 22R, 23R, and 24R are disposed on the travel route of the tape 29R. The pulleys 22R, 23R, and 24R are rotatably supported by a support shaft (not illustrated) via a bearing member (not illustrated) such as a bearing, for example, and movably support the tape 29R along the travel route.

As illustrated in FIG. 2, the pulleys 21L and 22L and the pulleys 21R and 22R form the conveyance unit 20 for bringing the paper money 2 into a state of being vertically nipped by the tapes 28L and 29L, and the tapes 28L and 29L, before the paper money 2 is winded around the drum 11D.

The drum 11D is supported by the shaft 11. As an example, the drum 11D illustrated in FIG. 2 is a drum continuously formed in a shaft direction (Y direction) of the shaft 11. The paper money 2 is winded around the drum 11D in a state of being nipped by the tapes 28L and 28R supplied from the reels 14L and 14R, and the tapes 29L and 29R supplied from the reels 15L and 15R.

The shaft 11 is an input shaft of drive force, and a drum drive mechanism 30 is connected thereto. For example, the drum drive mechanism 30 is a motor. The control unit 8 controls the drum drive mechanism 30, and at the time of roll-up of the tapes 28L to 29R, rotates the drum 11D in a clockwise rotation direction in a case where the paper sheet accommodating apparatus 5 is viewed in the Y forward direction. In addition, the control unit 8 controls the drum drive mechanism 30, and at the time of roll-back of the tapes 28L to 29R, rotates the drum 11D in a counterclockwise rotation direction in a case where the paper sheet accommodating apparatus 5 is viewed in the Y forward direction.

In addition, in the present embodiment, resin film tapes 28L to 29R are used as an example of a belt-like member, but a tape made of another material, or a belt-like member other than a tape may be used as necessary. In addition, in the present embodiment, two tapes of the tapes 28L and 28R are regarded as upside tapes, two tapes of the tapes 29L and 29R are regarded as downside tapes, and the paper money 2 is winded around the drum 11D with being vertically nipped by the upside tapes and the downside tapes, but the configuration is not limited to this. For example, one or three or more tapes may be regarded as upside tapes and downside tapes. Alternatively, the configuration is not limited to a configuration in which the paper money 2 is winded around the drum 11D with being vertically nipped by the upside tapes and the downside tapes, and for example, the paper money 2 may be winded around the drum 11D with being pushed against a drum outer periphery of the drum 11D only by the upside tapes. In this case, the shaft 15, the reels 15L and 15R, the gear 15GF, and the like can be omitted.

In addition, in the present embodiment, as an example, the drum 11D illustrated in FIG. 2 is assumed to be a drum continuously formed in the shaft direction (Y direction) of the shaft 11, but the configuration is not limited to this configuration, and the drum 11D may be a set of a plurality of drums separated in the shaft direction (Y direction) of the shaft 11.

[Connection Relationship between Shafts, Gears, and Reels]

Figure 5A:
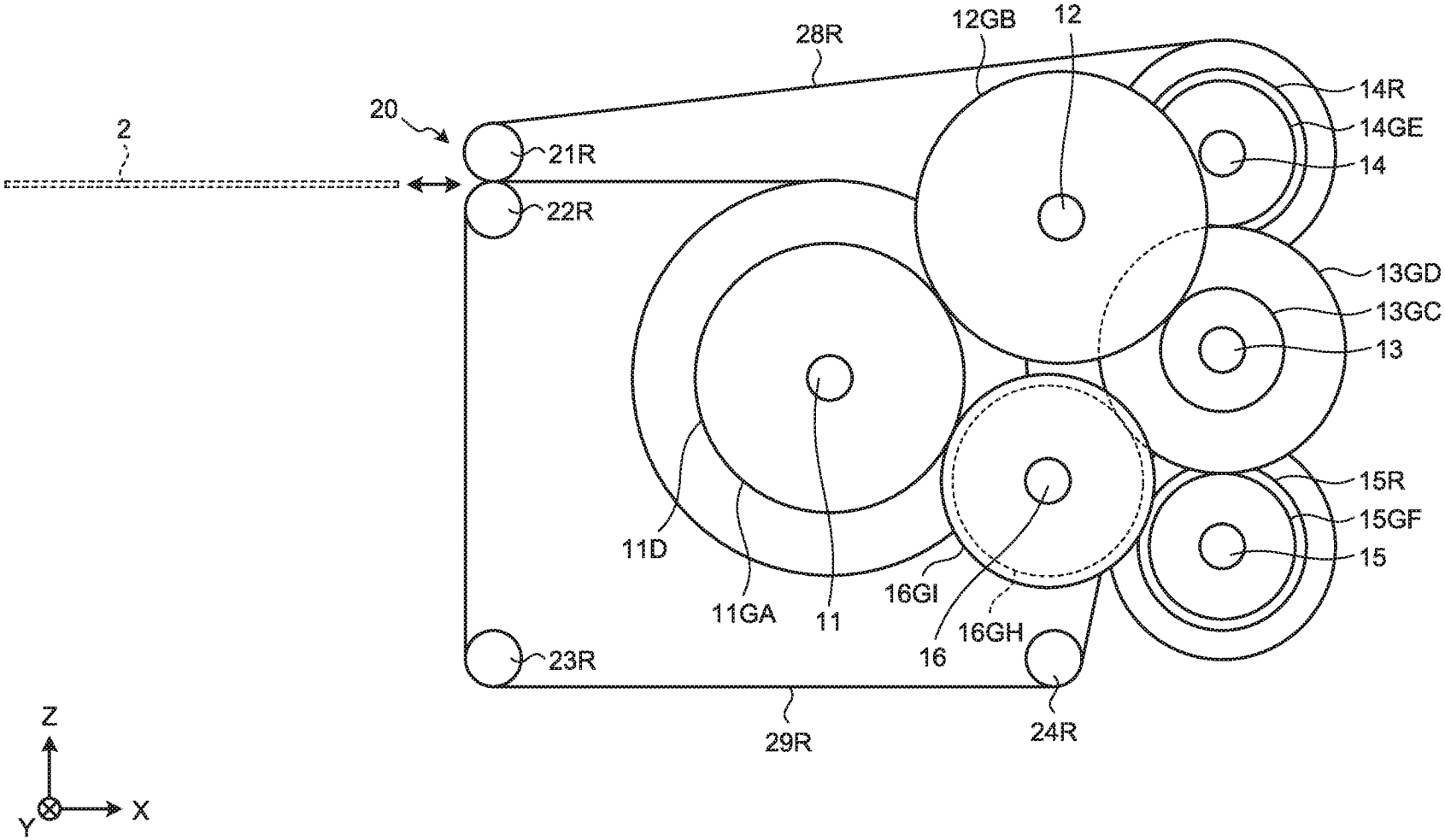
FIG. 5A is a side view illustrating the paper sheet accommodating apparatus according to an embodiment.
Figure 5B:
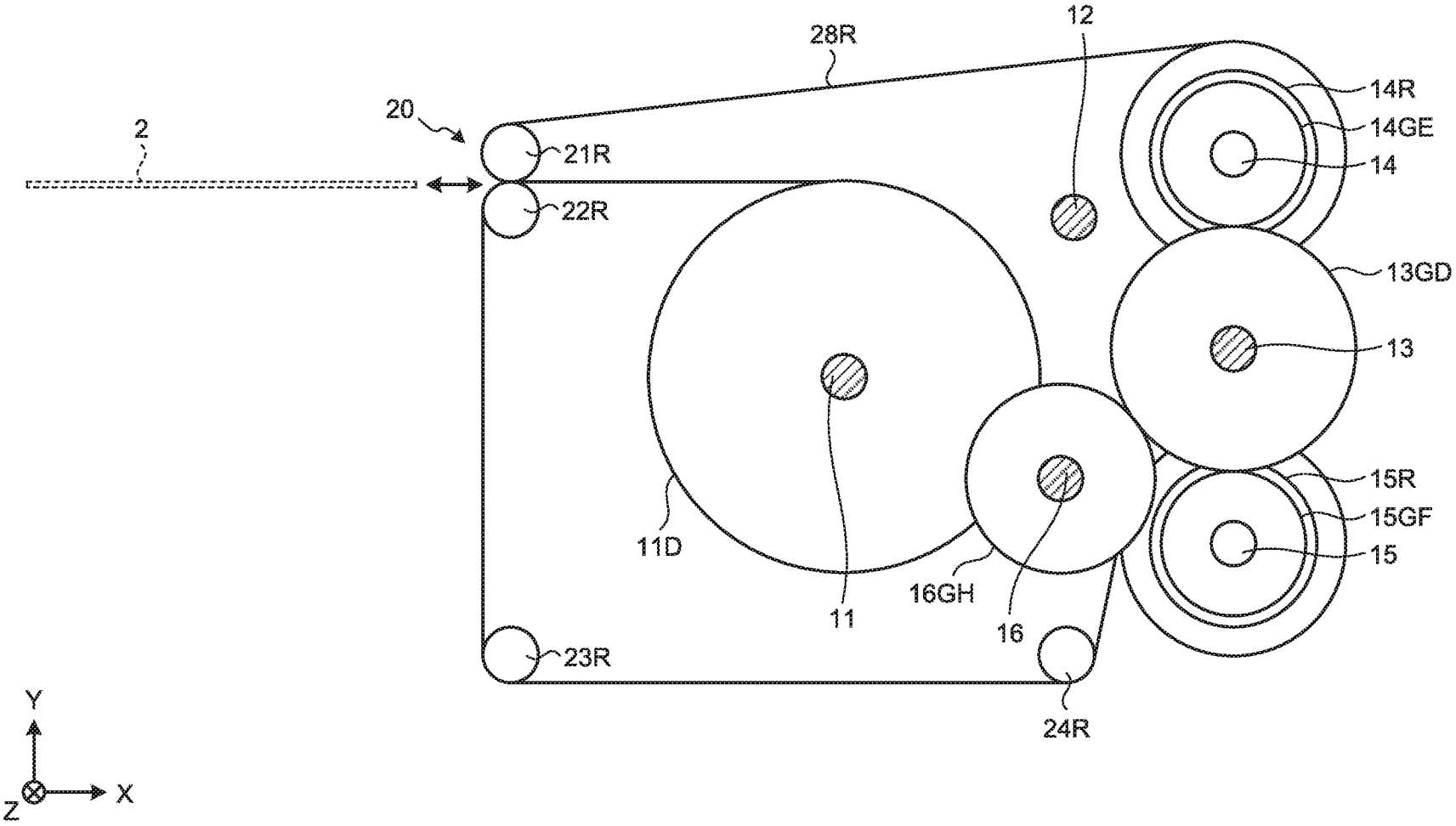
FIG. 5B is an A-A cross-sectional view illustrating the paper sheet accommodating apparatus according to an embodiment.

Next, a connection relationship between shafts, gears, and reels will be described with reference to FIGS. 5A and 5B. FIG. 5A is a side view illustrating the paper sheet accommodating apparatus according to an embodiment. FIG. 5B is an A-A cross-sectional view illustrating the paper sheet accommodating apparatus according to an embodiment. An A-A cross-section is a cross-section obtained by viewing a vertical cross-section extending along a dashed-dotted line illustrated in FIG. 3, in an A direction. As illustrated in FIG. 5A, the shaft 11 of the drum 11D is connected with the gear 11GA. The gear 11GA is connected with the gear 13GC via the gear 12GB. The gear 12GB is an idler gear connecting between the gear 11GA and the gear 13GC.

A one-way clutch (not illustrated) is attached to the gear 13GC, and disposed coaxially with the gear 13GD via the shaft 13. The gear 13GD is fixed to the shaft 13. To the gear 13GD, drive force is connected (transmitted) or disconnected (blocked) by the one-way clutch according to the rotation direction of the gear 13GC.

As a type of the one-way clutch, there are types such as a sprag type and a cam type, and drive force is connected and disconnected according to a speed difference between an outer race and an inner race. For example, in the one-way clutch, if the outer race side is rotated clockwise, the inner race side is disconnected from drive force and runs idle. In addition, in the one-way clutch, if the outer race side is rotated counterclockwise, drive force is connected to the inner race side, and the inner race side rotates counterclockwise. In addition, in the one-way clutch, if the inner race side is rotated counterclockwise, the outer race side is disconnected from drive force and runs idle. In addition, in the one-way clutch, if the inner race side is rotated clockwise, drive force is connected to the outer race side, and the outer race side rotates clockwise.

The gear 13GD is connected with the gears 14GE, 15GF, and 16GH. On the shaft 14 on which the gear 14GE is disposed, the reels 14L and 14R are disposed via a torque limiter (not illustrated). On the shaft 15 on which the gear 15GF is disposed, the reels 15L and 15R are disposed via a torque limiter (not illustrated).

A one-way clutch is attached to the gear 16GH, and disposed coaxially with the gear 16GI via the shaft 16. The gear 16GI is fixed to the shaft 16. To the gear 16GI, drive force is connected or disconnected by the one-way clutch according to the rotation direction of the gear 16GH.

In addition, the shaft 13, the gears 13GC and 13GD, the shaft 14, the gear 14GE, the shaft 15, the gear 15GF, the shaft 16, and the gears 16GH and 16GI are an example of a transmission unit that transmits, at the time of roll-up of a belt-like member that is caused by the rotation of the drum, rotation of a reel co-rotating with the roll-up, to the drum, and assists the rotation of the drum. In addition, in the present embodiment, "co-rotating" refers to the reels 14L to 15R rotating in accordance with belt-like members (tapes 28L to 29R) being supplied (pulled out) from the reels 14L to 15R according to the roll-up of the belt-like members around the drum 11D that is caused by the rotation of the drum 11D, for example.

In addition, the shaft 13, and the gears 13GC and 13GD are an example of a first transmission member to which rotation of a drum is that is caused by a drive unit is transmitted. In addition, the shaft 16, and the gears 16GH and 16GI are an example of a second transmission member.

[Rotation of Gears in Roll-Up Operation]

Figure 6A:
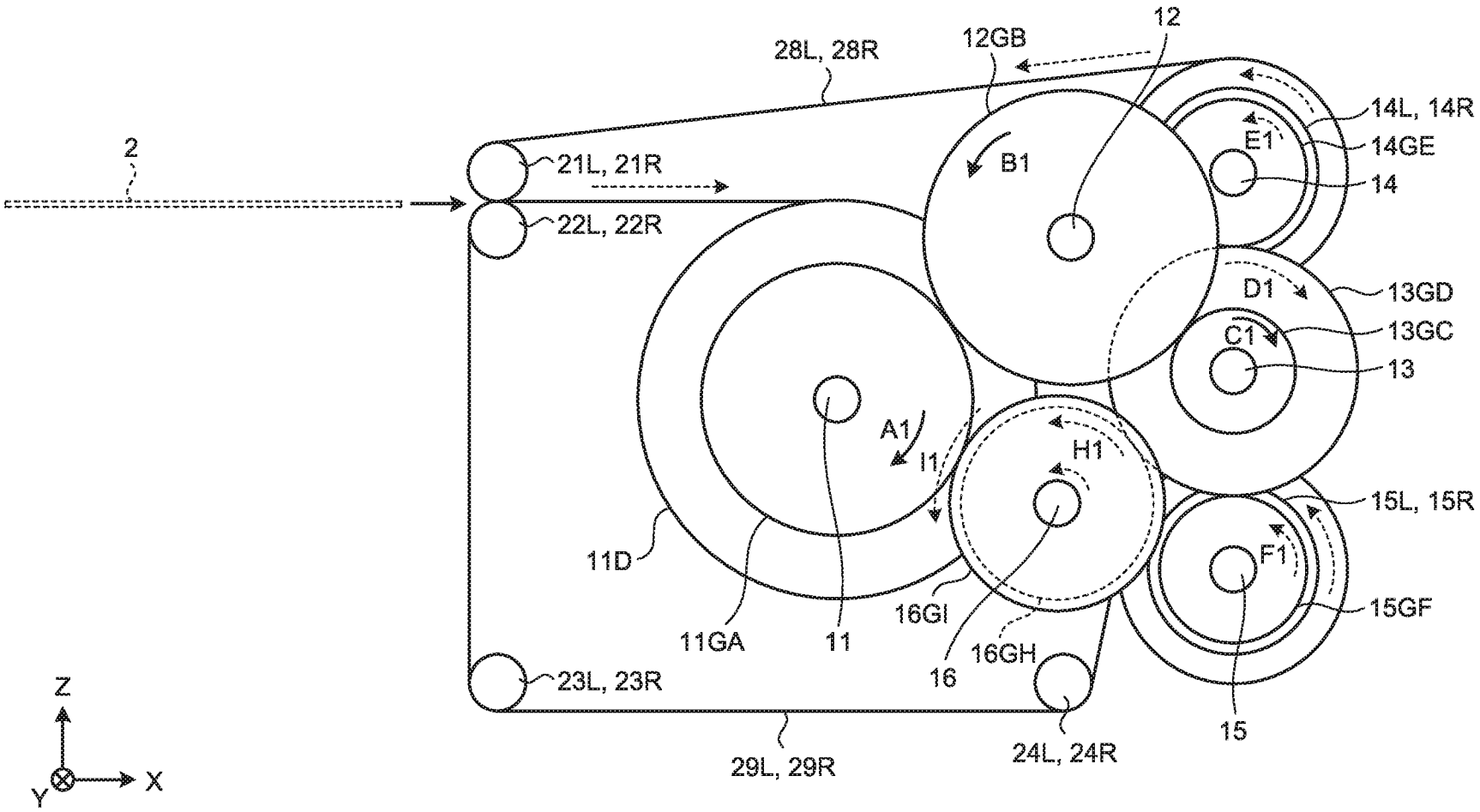
FIG. 6A is a schematic diagram illustrating the rotation of gears in a roll-up operation of the paper sheet accommodating apparatus according to an embodiment.

FIG. 6A is a schematic diagram illustrating the rotation of gears in a roll-up operation of the paper sheet accommodating apparatus according to an embodiment. Hereinafter, a broken line arrow indicates rotation caused by co-rotating with the tapes 28L to 29R by a roll-up operation of the drum 11D. In addition, a solid line arrow indicates rotation caused by transmission of rotation of the gear 11GA in a roll-up operation of the drum 11D.

If the drum 11D is rotated clockwise by the drum drive mechanism 30, the gear 13GC rotates clockwise (C1 direction) via the gears 11GA (rotates in an A1 direction) and 12GB (rotates in a B1 direction). At this time, because the one-way clutch of the gear 13GC is disposed so as to be in a free state, drive force is not transmitted from the gear 13GC to the shaft 13.

On the other hand, the tapes 28L to 29R are rolled up around the drum 11D, and the tapes 28L to 29R are respectively pulled out from the reels 14L to 15R. Thus, the reels 14L and 14R are co-rotated counterclockwise (broken line arrow) as illustrated in FIG. 6A. The rotation of the co-rotation rotates the shafts 14 and 15 and the gears 14GE and 15GF counterclockwise (E1 direction, F1 direction) via a torque limiter (not illustrated).

Then, the counterclockwise rotation of the gears 14GE and 15GF is transmitted, and the gear 13GD rotates clockwise (D1 direction). At this time, a relationship of the numbers of rotations between the gear 13GC and the gear 13GD is set as "the number of rotations of the gear 13GC>the number of rotations of the gear 13GD". With this configuration, in the one-way clutch (not illustrated) of the gear 13GC, drive forces of the gear 13GC and the gear 13GD are not connected, and a free state where the rotation of the outer race side is fast is maintained.

In addition, the gear 13GD is connected to the gear 16GH. The gear 16GH transmits drive force to the shaft 16 via the one-way clutch, and the shaft 16 rotates counterclockwise. Here, because the shaft 16 is fixed to the gear 16GI, the gear 16GH tries to rotate counterclockwise (H1 direction). Nevertheless, because the gear 16GI is connected with the gear 11GA, the gear 16GI rotates clockwise (A1 direction) at speed of the drum 11D.

At this time, the one-way clutch (not illustrated) of the gear 16GH makes the rotation of the outer race side to which co-rotation from the reels 14L to 15R is transmitted, always faster than the rotation of the inner race side transmitted from the gear 16GI, and a connection state is caused when the outer race side is rotating counterclockwise. In other words, "the number of rotations of the gear 16GH>the number of rotations of the gear 16GI" is set. With this configuration, on the shaft 16 via the one-way clutch (not illustrated), rotational force caused by co-rotation of the reels 14L to 15R, and rotational force of the drum 11D that is caused by the drum drive mechanism 30 collide.

Here, because the drum 11D is rotated by the drum drive mechanism 30 in the A1 direction at constant speed, rotation in an I1 direction of the gear 16GI that is caused by co-rotation of the reels 14L to 15R is suppressed (braked). On the other hand, because rotation in the I1 direction of the gear 16GI that is caused by co-rotation of the reels 14L to 15R becomes force that rotates the drum 11D in the A1 direction, the rotation becomes rotational force that assists rotation of the drum 11D. In addition, the difference in speed is canceled by torque limiters (not illustrated) respectively disposed between the reels 14L to 15R and the shafts 14 and 15 being reel shafts.

[Rotation of Gears in Roll-Back Operation]

Figure 6B:
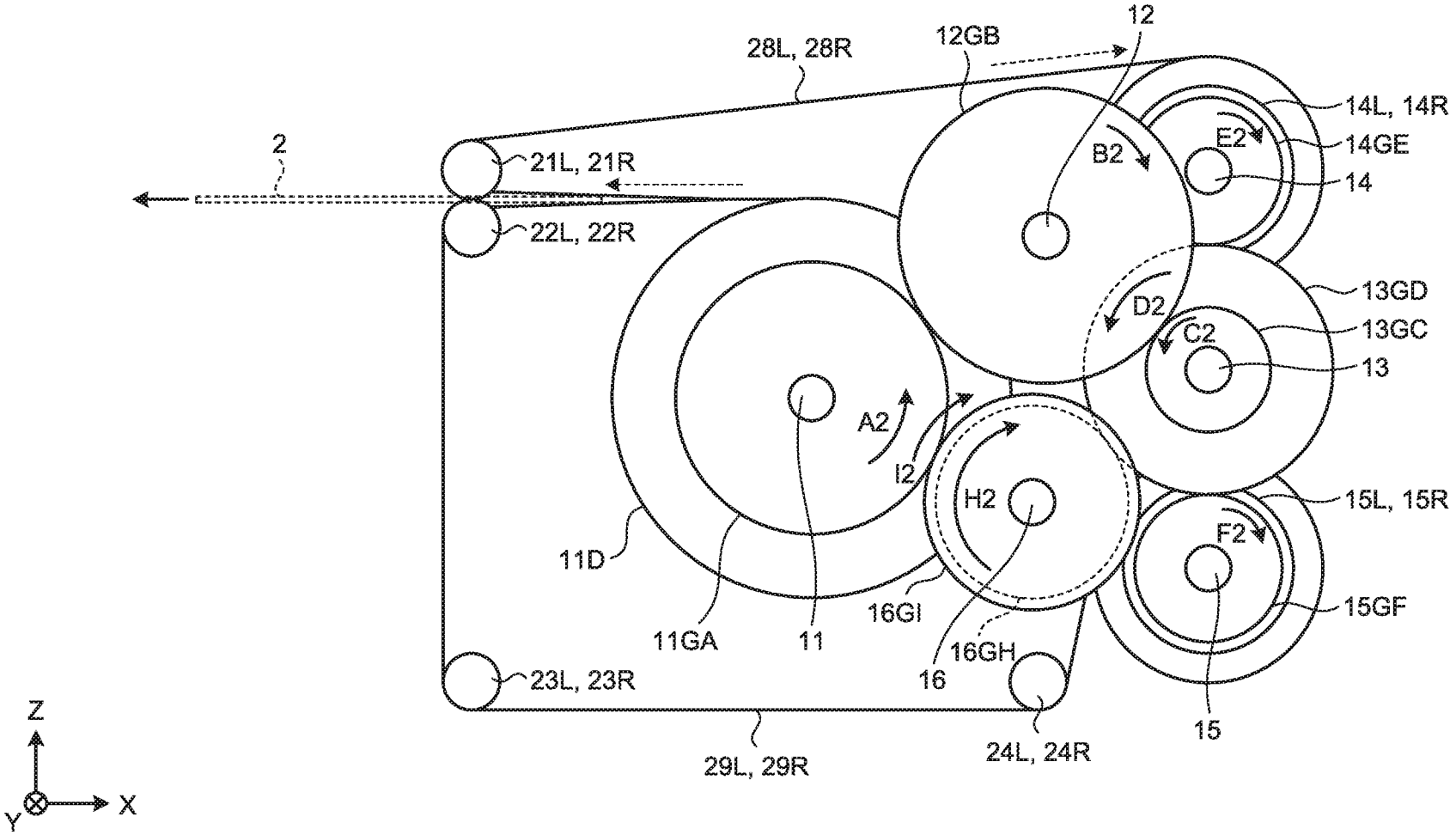
FIG. 6B is a schematic diagram illustrating the rotation of gears in a roll-back operation of the paper sheet accommodating apparatus according to an embodiment.

FIG. 6B is a schematic diagram illustrating the rotation of gears in a roll-back operation of the paper sheet accommodating apparatus according to an embodiment. If the drum 11D is rotated counterclockwise by the drum drive mechanism 30, the gear 13GC rotates counterclockwise (C2 direction) via the gears 11GA (rotates in an A2 direction) and 12GB (rotates in a B2 direction). At this time, because the one-way clutch (not illustrated) of the gear 13GC becomes a connection state by the rotation in a direction opposite to the roll-up ("the number of rotations of the gear 13GC>the number of rotations of the gear 13GD"), drive force is transmitted from the gear 13GC to the shaft 13. With this configuration, the gear 13GD rotates counterclockwise (D2 direction), and the gears 14GE, 15GF, and 16GH rotate clockwise (E2 direction, F2 direction, H2 direction).

By this gear coupling method, the numbers of rotations of the gear 11GA, and the gears 14GE and 15GF are set so as to satisfy "the number of rotations of the gear 11GA<the number of rotations of the gear 14GE (or 15GF)" (satisfy Formula (2) described below). By performing setting in this manner, the reels 14L to 15R rotate at higher speed than the drum 11D.

The tapes 28L to 29R are unreeled from the drum 11D by a constant amount, and the unreeled portions are rolled up by the reels 14L to 15R. Here, because the reels 14L to 15R rotate at higher speed than the drum 11D, appropriate tape tension of the tapes 28L to 29R is maintained, and the tapes 28L to 29R are rolled up around the reels 14L to 15R without slackness. In addition, rotation of the reels 14L to 15R generated in a state where the tapes 28L to 29R to be rolled up do not exist is canceled by sliding of a torque limiter (not illustrated) on the shafts 14 and 15. The sliding of the torque limiter becomes tape tension.

On the other hand, the one-way clutch (not illustrated) of the gear 16GH is disposed to be always in a free state. Nevertheless, because the gear 16GI is connected with the gear 11GA, the gear 16GI rotates at speed of the drum 11D. At this time, the one-way clutch (not illustrated) of the gear 16GH makes the outer race side always faster than the inner race side to which drive force is transmitted from the gear 16GI ("the number of rotations of the gear 16GH>the number of rotations of the gear 16GI"), and a disconnection state (free state) is caused when the outer race side is rotating clockwise. By performing setting in this manner, in the one-way clutch of the gear 16GH, a disconnection state (free state) where drive force is not transmitted is caused.

[Derivation Procedure of Gear Ratio]

Next, a derivation procedure of a gear ratio according to the present embodiment will be described. Hereinafter, first of all, a condition of a gear ratio in a roll-back operation is derived, and next, a condition of a gear ratio in roll-up is derived. The roll-back operation is an operation of the drum 11D unreeling the rolled-up tapes 28L to 29R, and rolling back around the reels 14L to 15R. The roll-up operation is an operation of the drum 11D rolling up the tapes 28L to 29R supplied from the reels 14L to 15R.

(Setting of Gear Ratio in Roll-Back Operation)

Hereinafter, a derivation procedure of a gear ratio in a roll-back operation will be described. In the roll-back, the numbers of rotations of the gear 11GA and the gears 14GE and 15GF are set as "the number of rotations of the gear 11GA<the number of rotations of the gear 14GE (or the gear 15GF)". The condition of the gear ratio is derived in the following manner. In addition, in the following description, in the setting of a gear ratio, the description can be given using "the gear 14GE" or "the gear 15GF" because "the gear 14GE" and "the gear 15GF" are similar gears.

When speed of the tapes 28L to 29R is denoted by V [mm/s], the speed V of the tapes 28L to 29R that corresponds to a diameter D [mm] of the drum 11D is set as in Formula (1) described below, using the number of rotations RD [rps] of the drum 11D.

(Math. 1)

$$V=D\times RD\times\pi \tag{1}$$

where,

D [mm]: a diameter of the drum 11D

RD [rps]: the number of rotations of the drum 11D.

Here, for making the speed V [mm/s] of the tapes 28L to 29R equal speed to that of another conveyance unit, the number of rotations RD [rps] of the drum is changed according to the drum diameter D [mm]. Thus, the speed V [mm/s] of the tapes 28L to 29R falls within the range of a value in Formula (2) described below.

$$V=D0\times RD0\times\pi \text{ to } Dm\times RDm\times\pi \tag{2}$$

where,

D0 [mm]: a diameter of the drum 11D when a roll-up amount of the tapes 28L to 29R is 0

Dm [mm]: a diameter (including paper money) of the drum 11D when the tapes 28L to 29R are rolled up at a maximum (to the limit)

RD0 [rps]: the number of rotations of the drum 11D when a roll-up amount of the tapes 28L to 29R is 0

RDm [rps]: the number of rotations (including paper money) of the drum 11D when the tapes 28L to 29R are rolled up at a maximum (to the limit)

On the other hand, because tape slackness is generated unless a tape speed Vr [mm/s] of the reels 14L to 15R is set to be equal to or larger than the speed V [mm/s] of the tapes 28L to 29R, the reels 14L to 15R are rotated so as to satisfy Formula (3) described below.

(Math. 3)

$$V \leq Vr \tag{3}$$

Similarly to the tape speed V [mm/s] of the drum 11D, the tape speed Vr [mm/s] of the reel falls within the range of a value in Formula (4) described below.

(Math. 4)

$$Vr = d \times Rd \times \pi = d0 \times Rd0 \times \pi \text{ to } dm \times Rdm \times \pi \tag{4}$$

where, d [mm]: a diameter of the reels 14L to 15R d0 [mm]: a diameter of the reels 14L to 15R when there is no tape dm [mm]: a diameter of the reels 14L to 15R when the tape is rolled up at a maximum (to the limit)

Rd [rps]: the number of rotations of the reels 14L to 15R

Rd0 [rps]: the number of rotations of the reels with a diameter of the reels 14L to 15R when there is no tape Rdm [rps]: the number of rotations of the reels with a diameter of the reels 14L to 15R when the tape is rolled up at a maximum (to the limit)

In other words, gear ratio coupling satisfying Formula (5) described below that is obtained by rewriting Formula (4) described above is performed. Here, in Formula (5) described below, [*] denotes arbitrary one value selected from among the range of the values of *.

(Math. 5)

$$V \leq Vr = [D0 \times RD0 \text{ to } Dm \times RDm] \times \pi \leq [d0 \times Rd0 \text{ to } dm \times Rdm] \times \pi$$

$$\leftrightarrow [D0 \times RD0 \text{ to } Dm \times RDm][d0 \times Rd0 \text{ to } dm \times Rdm] \tag{5}$$

Figure 7A:
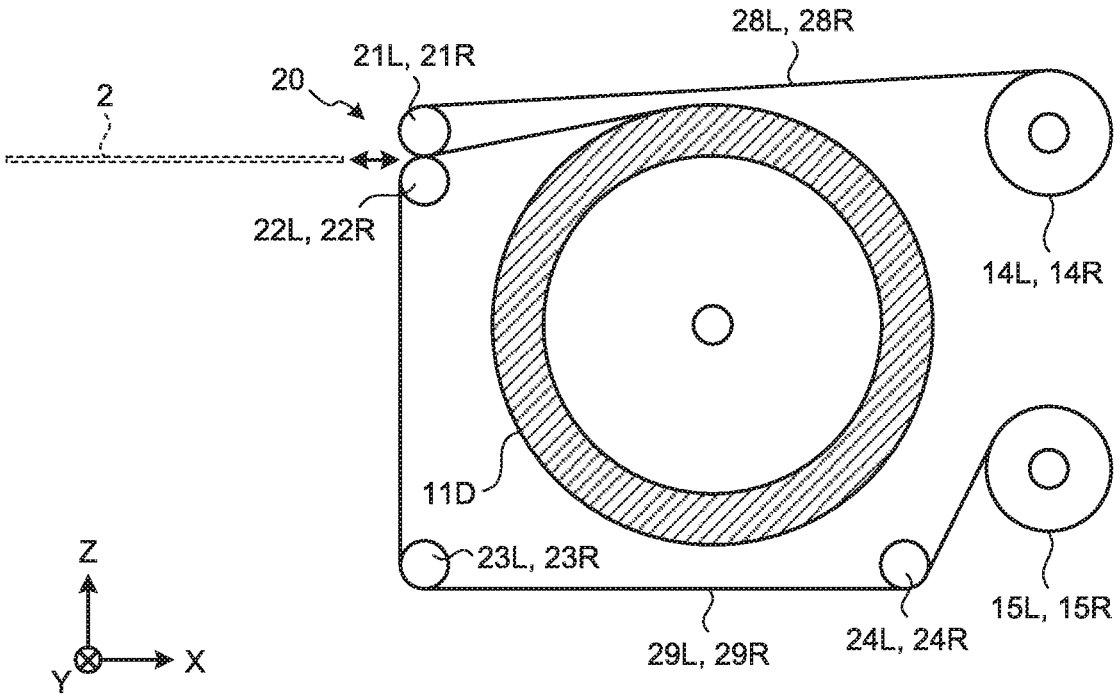
FIG. 7A is a schematic diagram illustrating a state where a tape is all rolled up around a drum in the paper sheet accommodating apparatus according to an embodiment.

Here, the number of rotations of the drum 11D when the tape is rolled up at a maximum (to the limit) becomes the slowest rotation, and the number of rotations of the reels 14L to 15R when there is no tape (refer to FIG. 7A) requests the fastest rotation. In other words, because the number of rotations of the drum 11D when there is no tape is faster than that of when the tape is rolled up at a maximum (to the limit), and the needed number of rotations of the reels 14L to 15R when the tape is rolled up at a maximum (to the limit) is slower than that of when there is no tape, from Formula (5) described above, un upper limit of the tape speed Vr [mm/s] of the reels 14L to 15R is obtained as in Formula (6) described below. FIG. 7A is a schematic diagram illustrating a state where a tape is all rolled up around a drum in the paper sheet accommodating apparatus according to an embodiment.

(Math. 6)

$$V \leq Vr = Dm \times RDm \leq d0 \times Rd0 \tag{6}$$

Because the number of rotations Rd [rps] of the reels 14L to 15R is decided by gear coupling with the drum 11D, the number of rotations Rd [rps] is represented as in Formula (7) described below.

(Math. 7)

$$Rd = Z \times RD \tag{7}$$

where,

Z: a gear ratio between the drum 11D and the reels 14L to 15R

Figure 7B:
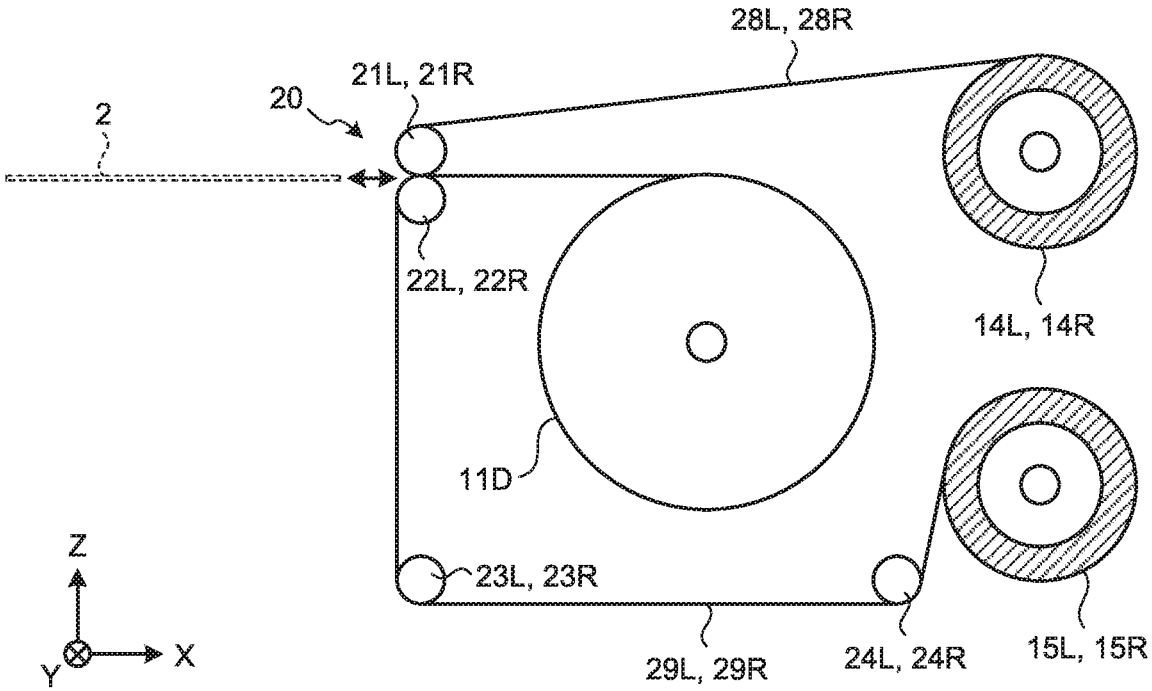
FIG. 7B is a schematic diagram illustrating a state where a tape is not rolled up around a drum in the paper sheet accommodating apparatus according to an embodiment.

A diameter of the drum 11D becomes largest when the tapes 28L to 29R do not exist on the reels 14L to 15R (refer to FIG. 7A), and when the tapes 28L to 29R are rolled up around the reels 14L to 15R at the maximum amount, a state where there is no tape on the drum 11D (refer to FIG. 7B) is caused. Thus, Formulae (8-1) and (8-2) described below are satisfied. FIG. 7B is a schematic diagram illustrating a state where a tape is not rolled up around a drum in the paper sheet accommodating apparatus according to an embodiment.

(Math. 8)

$$Rd0 = Z \times RDm \tag{8-1}$$

$$Rdm = Z \times RD0 \tag{8-2}$$

When Formulae (8-1) and (8-2) described above are substituted into Formula (6) described above, a minimum value of a gear ratio Z is obtained as in Formula (9) described below.

(Math. 9)

$$V \leq Vr$$

$$\leftrightarrow Dm \times RDm \leq d0 \times Rd0$$

$$\leftrightarrow Dm \times RDm \leq d0 \times Z \times RDm$$

$$\leftrightarrow Dm \leq d0 \times Z$$

$$\leftrightarrow Z \geq Dm/d0 \tag{9}$$

In the present embodiment, specifically, based on Formula (9) described above, a gear ratio is set as in Formula (10) described below.

(Math. 10)

$$Z = (\text{the number of gears of the gear } 11GA/\text{the number of gears of the gear } 13GC) \times (\text{the number of gears of the gear } 13GD/\text{the number of gears of the gear } 14GE \text{ (or the gear } 15GF)) \tag{10}$$

(Setting of Gear Ratio in Roll-Up Operation)

Hereinafter, a derivation procedure of a gear ratio in a roll-up operation will be described. In roll-up, in the one-way clutch of the gear 13GC, a condition where the number of rotations transmitted from the drum 11D always exceeds the number of rotations transmitted from the reels 14L to 15R is as in Formula (11) described below.

(Math. 11)

$$CRD1 \geq CRd1 \tag{11}$$

where,

CRD1: the number of rotations of rotations transmitted from the drum 11D to the one-way clutch of the gear 13GC CRd1: the number of rotations of rotations transmitted from the reels 14L to 15R to the one-way clutch of the gear 13GC By performing setting in this manner, as for a speed difference of the one-way clutch of the gear 13GC, the drum 11D side becomes always faster, and a state where the outer race side rotates clockwise, and the inner race side runs idle (free state) is maintained. Here, a speed of rotation caused by the reels 14L to 15R being co-rotated by the tapes 28L to 29R is decided by the tape speed V [mm/s] caused by the drum 11D, and because the tape speed V [mm/s] is kept constant, from Formulae (1), (4), and (11) described above, Formula (12) described below is satisfied.

(Math. 12)

$$CRD1 \geq CRd1$$

$$\leftrightarrow V/(D\times\pi)\times Z1 \geq Vr/(d\times\pi)\times Z2$$

$$\leftrightarrow V/(D\times\pi)\times Z1 \geq V/(d\times\pi)\times Z2$$

$$\leftrightarrow RD\times Z1 \geq (D\times RD\times\pi)/(d\times\pi)\times Z2$$

$$\leftrightarrow Z1 \geq D/d\times Z2 \quad (12)$$

where,

Z1: a gear ratio from the drum 11D to the one-way clutch of the gear 13GC Z2: a gear ratio from the reels 14L to 15R to the one-way clutch of the gear 13GC (becomes "1/Z2" when viewed from the one-way clutch)

In Formula (12) described above, because a time of Dm and d0 (when the drum 11D rolls up all the tapes 28L to 29R, refer to FIG. 7A) is the hardest condition, from Formula (12) described above, Formula (13) described below is satisfied.

(Math. 13)

$$CRD1 \geq CRd1$$

$$\leftrightarrow Z1 \geq D/d\times Z2$$

$$\leftrightarrow Z1 \geq Dm/d0\times Z2 \quad (13)$$

As seen from Formulae (9) and (13) described above, when Z=Z1/Z2 is set, Formula (14) described below is satisfied.

(Math. 14)

$$Z \geq Dm/d0$$

$$\leftrightarrow Z1\times(1/Z2) \geq Dm/d0 \quad (14)$$

Next, in the one-way clutch of the gear 16GH, a condition where the number of rotations transmitted from the reels 14L to 15R always exceeds the number of rotations transmitted from the drum 11D becomes as in Formula (15) described below.

(Math. 15)

$$CRd2 \geq CRD2 \quad (15)$$

where,

CRd2: the number of rotations of rotations transmitted from the reels 14L to 15R to the one-way clutch of the gear 16GH CRD2: the number of rotations of rotations transmitted from the drum 11D to the one-way clutch of the gear 16GH By performing setting in this manner, as for a speed difference of the one-way clutch of the gear 16GH, the reels 14L to 15R side becomes always faster, and a state where the outer race side rotates counterclockwise and is connected with the inner race side is maintained. Here, the speed Vr [mm/s] of rotation caused by the reels 14L to 15R being co-rotated by the tapes 28L to 29R satisfies Formula (16) described below, from Formulae (4) and (15) described above.

(Math. 16)

$$CRd2 \geq CRD2$$

$$\leftrightarrow Vr/(d\times\pi)\times(Z2\times Z4) \geq RD\times Z3$$

$$\leftrightarrow V/(d\times\pi)\times(Z2\times Z4) \geq RD\times Z3$$

$$\leftrightarrow RD\times D\times\pi/(d\times\pi)\times(Z2\times Z4) \geq RD\times Z3$$

$$\leftrightarrow D/d\times(Z2\times Z4) \geq Z3$$

$$\leftrightarrow Z2\times Z4 \geq d/D\times Z3 \quad (16)$$

where,

CRD2: the drum side number of rotations of the one-way clutch of the gear 16GH CRd2: the reel side number of rotations of the one-way clutch of the gear 16GH Z3: a gear ratio from the drum 11D to the one-way clutch of the gear 16GH Z4: a gear ratio from the gear 13GD to the one-way clutch of the gear 16GH ("1/Z4" when viewed from the one-way clutch)

In Formula (16) described above, because a time of Dm and d0 (when the drum 11D rolls up all the tapes 28L to 29R, refer to FIG. 7A) is the hardest condition, from Formula (16) described above, Formula (17) described below is satisfied.

(Math. 17)

$$Z2\times Z4 \geq d/D\times Z3$$

$$\leftrightarrow Z2\times Z4 \geq dm/D0\times Z3 \quad (17)$$

By satisfying Formula (17) described above, in the gear 16GH, the number of rotations caused by reel co-rotation always exceeds the number of rotations caused by the drum 11D, and in the one-way clutch of the gear 16GH, a state where the outer race side rotates counterclockwise and is connected with the inner race side is maintained.

In the present embodiment, specifically, based on Formula (17) described above, a gear ratio is set as in Formulae (18-1) to (18-5) described below.

(Math. 18)

$$Z = (\text{the number of gears of the gear } 11GA/\text{the number of gears of the gear } 13GC)\times(\text{the number of gears of the gear } 13GD/\text{the number of gears of the gear } 14GE \text{ (or the gear } 15GF)) \quad (18\text{-}1)$$

where, $$Z1 = \text{the number of gears of the gear } 11GA\times\text{the number of gears of the gear } 13GC \quad (18\text{-}2)$$

$$Z2 = \text{the number of gears of the gear } 14GE \text{ (or the gear } 15GF)\times\text{the number of gears of the gear } 13GD \quad (18\text{-}3)$$

$$Z3 = \text{the number of gears of the gear } 11GA\times\text{the number of gears of the gear } 16GI \quad (18\text{-}4)$$

$$Z4 = \text{the number of gears of the gear } 13GD\times\text{the number of gears of the gear } 16GH \quad (18\text{-}5)$$

Furthermore, a gear ratio is set as in Formulae (18-1) to (18-5) described above, and in roll-back, the one-way clutch of the gear 13GC sets a constraint condition of the gear ratio in such a manner that the number of rotations transmitted from the drum 11D always exceeds the number of rotations transmitted from the reels 14L to 15R. Here, in the roll-back, because co-rotation of the reels 14L to 15R does not occur, by the condition of Formula (14) described above, as for the speed of the one-way clutch of the gear 13GC, because the number of rotations transmitted from the drum 11D becomes always faster than the number of rotations transmitted from the reels 14L to 15R, in the one-way clutch of the gear 13GC, a state where the outer race side rotates counterclockwise and is connected with the inner race side is maintained.

On the other hand, in roll-back, unlike in the roll-up, in the one-way clutch of the gear 16GH, rotation transmitted from the drum 11D and rotation connected by the one-way clutch of the gear 13GC collide. At this time, similarly to roll-up, a gear ratio is set so as to satisfy Formula (19) described below, in such a manner that the number of rotations transmitted from the reels 14L to 15R via the one-way clutch of the gear 13GC exceeds the number of rotations transmitted from the drum 11D via the one-way clutch of the gear 16GH. By setting a gear ratio in this manner, because the outer race side always rotates clockwise and the inner race side runs idle (free state) in the one-way clutch of the gear 16GH, contrariety of rotation can be avoided.

(Math. 19)

$$CRd2 \geq CRD2$$

$$\leftrightarrow RD \times (Z1 \times Z4) \geq RD \times Z3$$

$$\leftrightarrow Z1 \times Z4 \geq Z3 \quad (19)$$

As described above, a setting condition of a gear ratio becomes as follows.

Figure 8A:
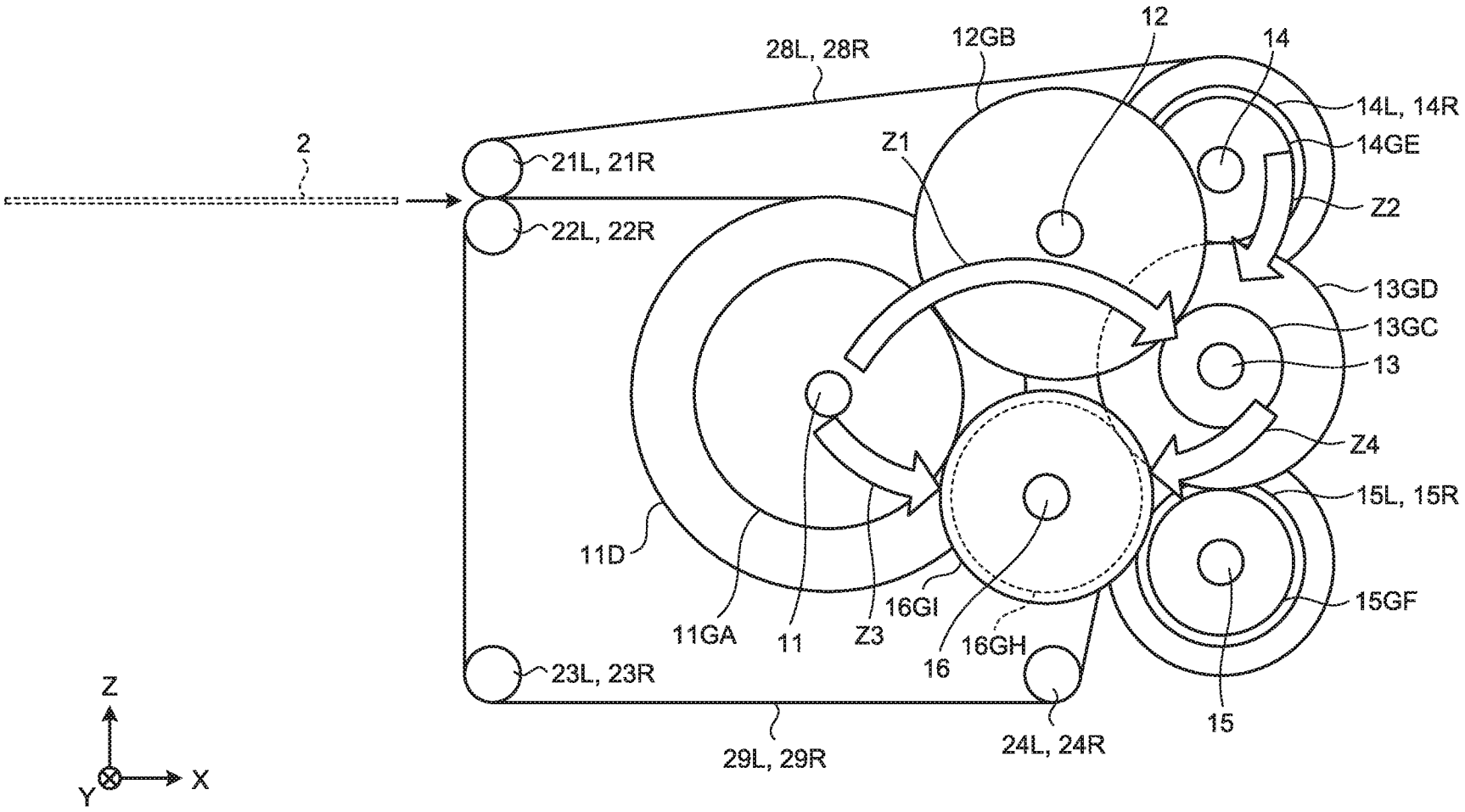
FIG. 8A is a schematic diagram illustrating transmission of the rotation of a gear in a roll-up operation of the paper sheet accommodating apparatus according to an embodiment.

(Math. 20)

$$Z1 \times (1/Z2) \geq Dm/d0 \quad (20\text{-}1)$$

$$Z2 \times Z4 \geq dm/D0 \times Z3 \quad (20\text{-}2)$$

$$Z1 \times Z4 \geq Z3 \quad (20\text{-}3)$$

where, $Z1$=the number of gears of the gear 11$GA$×the number of gears of the gear 13$GC$ $Z2$=the number of gears of the gear 14$GE$ (or the gear 15$GF$)×the number of gears of the gear 13$GD$ $Z3$=the number of gears of the gear 11$GA$×the number of gears of the gear 16$GI$ $Z4$=the number of gears of the gear 13$GD$×the number of gears of the gear 16$GH$ By setting a gear ratio as in Formulae (20-1) to (20-3) described above, as illustrated in FIG. 8A, in a roll-up operation, rotational force caused by co-rotation of the reels 14L to 15R that is caused by the supply of the tapes 28L to 29R that is caused by counterclockwise rotation of the drum 11D can be transmitted to the rotation of the drum 11D, and the rotation of the drum 11D can be assisted. FIG. 8A is a schematic diagram illustrating transmission of the rotation of a gear in a roll-up operation of the paper sheet accommodating apparatus according to an embodiment.

Figure 8B:
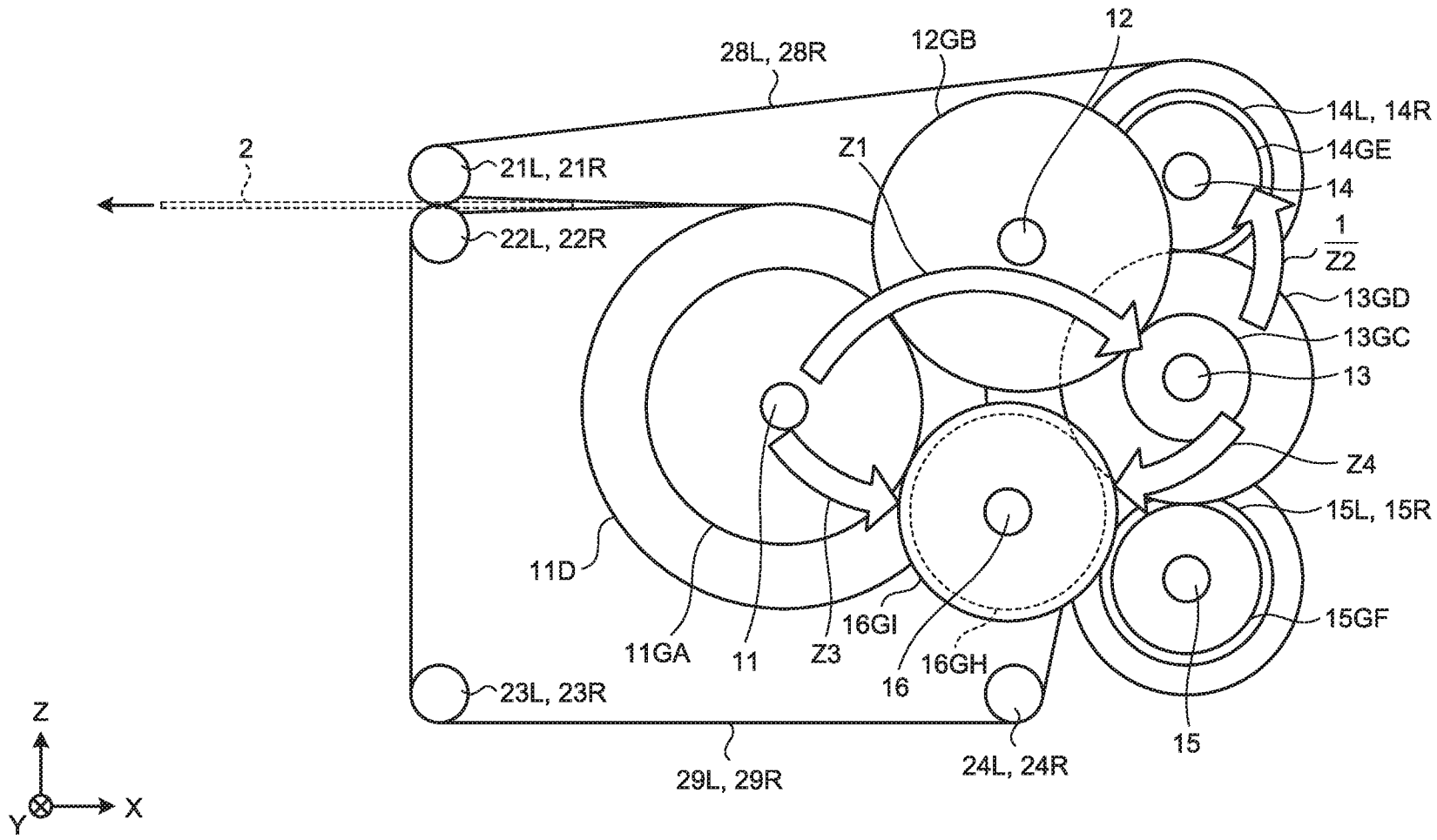
FIG. 8B is a schematic diagram illustrating transmission of the rotation of a gear in a roll-back operation of the paper sheet accommodating apparatus according to an embodiment.

In addition, by setting a gear ratio as in Formulae (20-1) to (20-3) described above, as illustrated in FIG. 8B, in a roll-back operation, rotation is transmitted between gears without contrariety. FIG. 8B is a schematic diagram illustrating transmission of the rotation of a gear in a roll-back operation of the paper sheet accommodating apparatus according to an embodiment.

Thus, according to the above embodiment, in a roll-up operation, by regenerating rotational force of co-rotation of the reels 14L to 15R that is generated by supply of the tapes 28L to 29R that is caused by the rotation of the drum 11D, for the rotation of the drum 11D, motor load or the like in the roll-up operation can be reduced.

Figure 9:
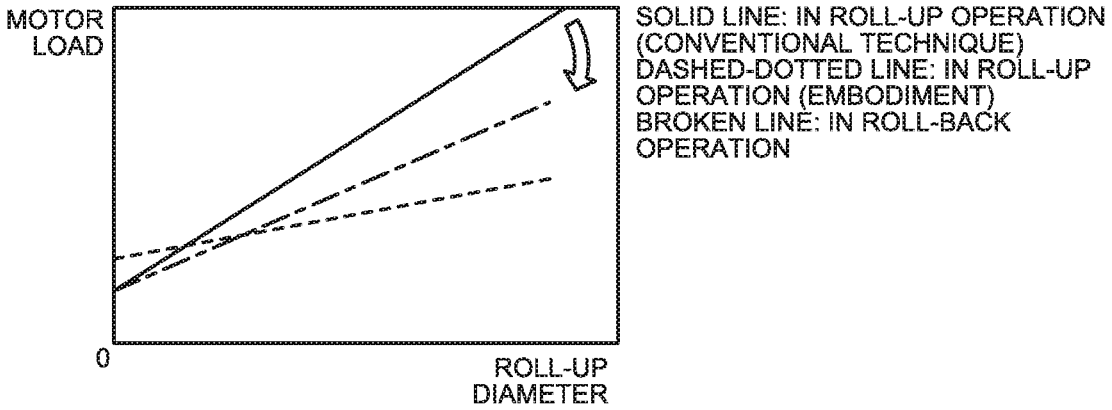
FIG. 9 is a diagram illustrating a relationship between a roll-up diameter of a roll-up drum that is obtainable at the time of roll-up of a tape that is performed by the roll-up drum, and pull-out load applied when the tape is pulled out from a reel, in the case of comparison with a related technique.

FIG. 9 is a diagram illustrating a relationship between a roll-up diameter of a roll-up drum that is obtainable at the time of roll-up of a tape that is performed by the roll-up drum, and pull-out load applied when the tape is pulled out from a reel, in the case of comparison with a related technique.

As illustrated in FIG. 9, in the roll-up operation, as a roll-up diameter of the drum 11D becomes larger, load of the drum drive mechanism 30 such as a motor that drives the drum 11D becomes larger. In a process from a state where a tape is not rolled up around a drum before the start of the roll-up operation that is illustrated in FIG. 7B, to a state where the tape is all rolled up around the drum after the start of the roll-up operation that is illustrated in FIG. 7A, the roll-up diameter of the drum 11D becomes larger. In the present embodiment, in the roll-up operation, as compared with the related technique, as indicated by a dashed-dotted line in FIG. 9, an increase in motor load that is proportionate to the roll-up diameter is reduced as compared with the related technique indicated by the solid line. On the other hand, in the present embodiment, as indicated by a broken line in FIG. 9, in the roll-back operation, an increase in motor load that is proportionate to the roll-up diameter becomes similar to the related technique.

Thus, because load of the drum drive mechanism 30 such as a motor is reduced, in a motor or the like that has the same output, a roll-up operation can be performed at higher speed. Alternatively, because drive load is reduced even if a roll-up diameter of the drum 11D becomes larger, a larger amount of tapes can be rolled up, and an accommodation amount of the paper sheet accommodating apparatus 5 can be increased.

Alternatively, using the drum drive mechanism 30 such as a motor that has lower output and inexpensive, a roll-up operation can be performed at speed similar to the related technique, and energy saving and low cost can be achieved. In addition, because the drum drive mechanism 30 such as a motor that has lower output is more compact, downsizing of the drum drive mechanism 30 and the paper sheet accommodating apparatus 5 can be achieved.

In addition, in the above embodiment, as compared with the related technique, by a reel shaft rotating in the roll-up operation, the number of differential rotations of a torque limiter becomes smaller, and force for actuating the torque limiter is reduced. Thus, a low-cost torque limiter having low rotation and enhanced life becomes available.

Modified Example

In the above embodiment, the first one-way clutch is disposed in the gear 13GC, and the second one-way clutch is disposed in the gear 16GH. Nevertheless, the configuration is not limited to this, and the first one-way clutch may be disposed on a drum shaft (the shaft 11). When the first one-way clutch is disposed on the drum shaft (the shaft 11), a gear ratio Z1=1 is obtained.

In addition, in the above embodiment, drive force of the drum drive mechanism 30 such as a motor is input to the drum shaft (the shaft 11), but the configuration is not limited to this, and drive force may be input to at least any of the gears 11GA, 12GB, 13GC, 16GI, and the like.

In addition, in the above embodiment, transmission of rotational force is performed by the gears 11GA, 12GB, 13GC, 13GD, 16GI, and 16GH, but the configuration is not limited to this, and transmission of rotational force may be performed by a belt, a drive chain, and the like.

The configurations of the units exemplified in the above embodiment can be changed or omitted without departing from the technical scope of a paper sheet accommodating apparatus and a paper sheet accommodating method according to the disclosed technique. In addition, the embodiment is mere exemplification, and starting with a mode described in the field of the disclosure of the invention, other modes on which various modifications and improvements are performed based on the knowledge of the one skilled in the art are included in the disclosed technique.

According to an example of the disclosed technique, in a paper sheet accommodating apparatus, for example, at the time of roll-up of a tape that is performed by a drum, pull-out load applied when the tape is pulled out from a reel can be reduced.

All examples and conditional language provided herein are intended for the pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet accommodating apparatus comprising:

a reel configured to supply a winded belt-like member;

a drum configured to roll up a paper sheet together with the belt-like member supplied from the reel; and a transmission unit configured to transmit rotation of the reel to the drum, to assist rotation of the drum, wherein the drum is rotated by a drum drive mechanism in a predetermined direction at constant speed, so that rotation in another predetermined direction of a gear that is caused by co-rotation of the reel becomes a force that rotates the drum in the predetermined direction and the rotation assists the rotation of the drum, wherein the paper sheet accommodating apparatus includes a drive unit configured to drive rotation of the drum, wherein the transmission unit includes a first transmission member to which rotation of the drum that is caused by the drive unit is transmitted, a first one-way clutch provided on the first transmission member, a second transmission member, and a second one-way clutch provided on the second transmission member, and wherein at a time of roll-up of the belt-like member that is caused by rotation of the drum, the first one-way clutch blocks rotation of the drum without transmitting the rotation from the first transmission member to the second transmission member, and transmits rotation of the reel co-rotating with the roll-up, from the reel to the second transmission member, and the second one-way clutch transmits rotation of the reel from the second transmission member to the drum in a same rotation direction as rotation of the drum, wherein at a time of roll-back of the belt-like member to the reel that is caused by rotation of the drum, the first one-way clutch transmits rotation of the drum from the first transmission member to the reel in a same rotation direction as roll-back of the belt-like member of the reel, and transmits rotation of the drum from the first transmission member to the second transmission member, and the second one-way clutch blocks rotation of the drum transmitted from the first transmission member, without transmitting the rotation from the second transmission member to the drum, wherein the second one-way clutch of a gear makes an outer race side faster than an inner race side to which drive force is transmitted from another gear pivotally supported by a same shaft as a shaft of the gear, and a disconnection state is caused when the outer race side is rotating clockwise.

2. The paper sheet accommodating apparatus according to claim 1, including at least two reels, wherein the drum rolls up the paper sheet in a state where the paper sheet is nipped by the belt-like members supplied from the respective reels.

3. The paper sheet accommodating apparatus according to claim 1, wherein the first transmission member and the second transmission member are gears.

4. A paper sheet accommodating method comprising:

rolling up a paper sheet around a drum together with a belt-like member supplied from a reel; and transmitting rotation of the reel to the drum, so that a transmission unit assists rotation of the drum, wherein the drum is rotated by a drum drive mechanism in a predetermined direction at constant speed, so that rotation in another predetermined direction of a gear that is caused by co-rotation of the reel becomes a force that rotates the drum in the predetermined direction and the rotation assists the rotation of the drum, wherein the paper sheet accommodating apparatus includes a drive unit configured to drive rotation of the drum, wherein the transmission unit includes a first transmission member to which rotation of the drum that is caused by the drive unit is transmitted, a first one-way clutch provided on the first transmission member, a second transmission member, and a second one-way clutch provided on the second transmission member, and wherein at a time of roll-up of the belt-like member that is caused by rotation of the drum, the first one-way clutch blocks rotation of the drum without transmitting the rotation from the first transmission member to the second transmission member, and transmits rotation of the reel co-rotating with the roll-up, from the reel to the second transmission member, and the second one-way clutch transmits rotation of the reel from the second transmission member to the drum in a same rotation direction as rotation of the drum, wherein at a time of roll-back of the belt-like member to the reel that is caused by rotation of the drum, the first one-way clutch transmits rotation of the drum from the first transmission member to the reel in a same rotation direction as roll-back of the belt-like member of the reel, and transmits rotation of the drum from the first transmission member to the second transmission member, and the second one-way clutch blocks rotation of the drum transmitted from the first transmission member, without transmitting the rotation from the second transmission member to the drum, wherein the second one-way clutch of a gear makes an outer race side faster than an inner race side to which drive force is transmitted from another gear pivotally supported by a same shaft as a shaft of the gear, and a disconnection state is caused when the outer race side is rotating clockwise.

* * * * *